US007918345B2

(12) United States Patent
Molteni

(10) Patent No.: US 7,918,345 B2
(45) Date of Patent: Apr. 5, 2011

(54) ELECTROMAGNETIC SEPARATOR AND SEPARATION METHOD OF FERROMAGNETIC MATERIALS

(75) Inventor: Danilo Molteni, Manerbio (IT)

(73) Assignee: SGM Gantry S.p.A., Manerbio BS (IT)

( * ) Notice: Subject to any disclaimer, the term of this patent is extended or adjusted under 35 U.S.C. 154(b) by 82 days.

(21) Appl. No.: 12/304,985

(22) PCT Filed: Jun. 15, 2006

(86) PCT No.: PCT/IT2006/000453

§ 371 (c)(1), (2), (4) Date: Mar. 6, 2009

(87) PCT Pub. No.: WO2007/144912

PCT Pub. Date: Dec. 21, 2007

(65) Prior Publication Data

US 2009/0314690 A1 Dec. 24, 2009

(51) Int. Cl.
*B03C 1/00* (2006.01)
*B03C 1/30* (2006.01)

(52) U.S. Cl. ..... 209/215; 209/223.1; 209/223.2; 209/224; 209/40

(58) Field of Classification Search ..... 209/223.1, 209/223.2, 224, 215, 40
See application file for complete search history.

(56) References Cited

U.S. PATENT DOCUMENTS

| | | | | |
|---|---|---|---|---|
| 3,503,504 | A * | 3/1970 | Bannister | 209/223.1 |
| 3,552,565 | A * | 1/1971 | Fritz | 209/219 |
| 4,003,830 | A * | 1/1977 | Schloemann | 209/3 |
| 4,062,765 | A | 12/1977 | Fay et al. | |
| 4,125,191 | A * | 11/1978 | Peace | 209/636 |
| 4,702,825 | A | 10/1987 | Selvaggi et al. | |
| 4,726,904 | A | 2/1988 | Ayers | |
| 4,780,113 | A | 10/1988 | Koslow | |
| 4,832,834 | A * | 5/1989 | Baird, Jr. | 209/397 |
| 4,869,811 | A * | 9/1989 | Wolanski et al. | 209/212 |
| 5,423,433 | A * | 6/1995 | Arnold et al. | 209/636 |
| 6,253,924 | B1 * | 7/2001 | Bleifuss et al. | 209/223.1 |
| 2003/0127366 | A1 | 7/2003 | Ikeda et al. | |
| 2003/0196935 | A1 | 10/2003 | Miles et al. | |

FOREIGN PATENT DOCUMENTS

| | | |
|---|---|---|
| DE | 2007 529 | 9/1971 |
| FR | 2 722 120 | 1/1996 |
| GB | 100 062 | 4/1917 |
| GB | 152 549 | 10/1920 |
| GB | 607 682 | 9/1948 |
| GB | 1 083 581 | 9/1967 |
| GB | 1 253 996 | 11/1971 |
| GB | 1 282 930 | 7/1972 |
| WO | WO 2005/120714 | 12/2005 |

OTHER PUBLICATIONS

International Search Report dated May 7, 2007, International Application No. PCT/IT2006/000453 filed Jun. 15, 2006, 6 pages.

* cited by examiner

*Primary Examiner* — Terrell H Matthews
(74) *Attorney, Agent, or Firm* — Haynes and Boone, LLP

(57) ABSTRACT

Electromagnetic separator comprising two or more solenoids (6, 7) arranged inside a rotatable drum (1) and connected to a continuous current power supply (8) for generating a magnetic field suitable for separating ferromagnetic parts, wherein said power supply (8) supplies a current being substantially constant in time. The invention also relates to a separation method that can be carried out by means of said electromagnetic separator.

3 Claims, 1 Drawing Sheet

ELECTROMAGNETIC SEPARATOR AND SEPARATION METHOD OF FERROMAGNETIC MATERIALS

Figure 1:
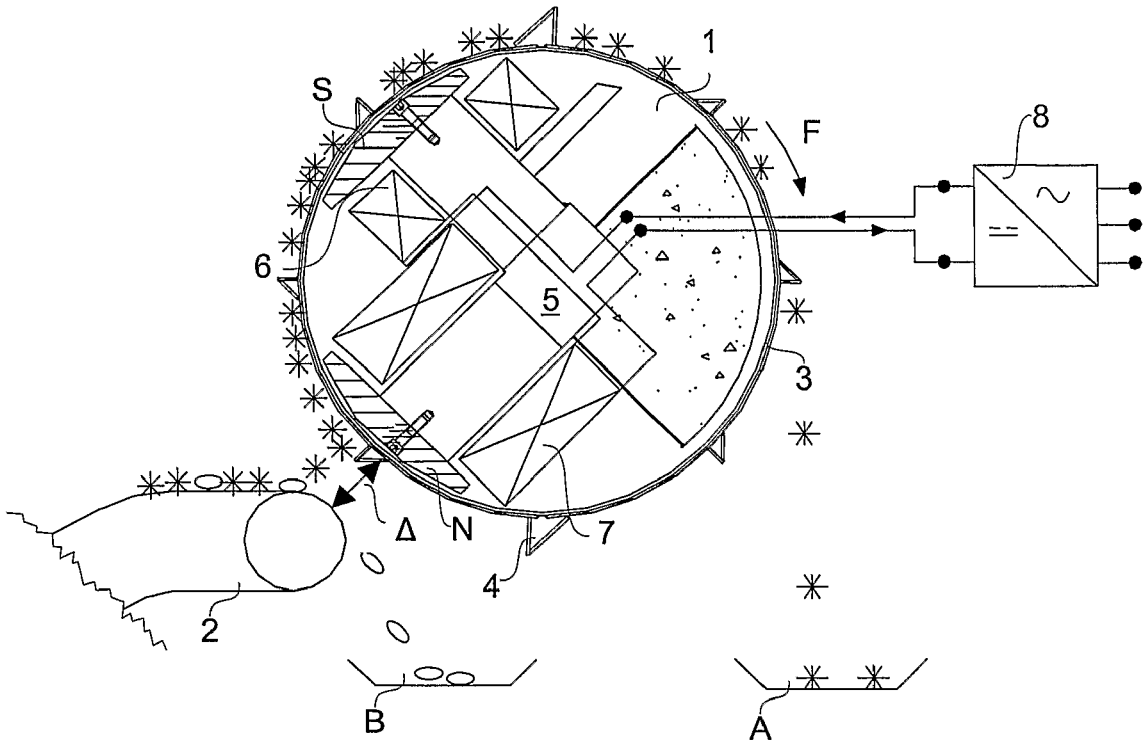

The present invention relates to an electromagnetic separator and a separation method of ferromagnetic materials, and particularly to a separator and a method allowing to separate ground ferromagnetic parts containing copper, thus significantly reducing the manual operations for their separation from other ferromagnetic parts.

In the recovering processes of the materials deriving from vehicles grinding, also known as "proler", the ferromagnetic parts being ground and separated from the non-ferromagnetic ones by an electromagnetic separator can be advantageously reused for the production of steel. In the flow of ferromagnetic material coming from this separator, it is important to further separate ferromagnetic parts containing copper, such as the rotors of the electric motors. In fact, as it is known, copper pollutes the molten steel producible from ground ferromagnetic materials and thereby it is advantageous that it is present in percentages being not greater than 0.15%.

Numerous electromagnetic separators and separation methods are known, for instance providing for the use of rotating electromagnetic drums arranged at the outlet of a grinding mill, in order to separate ferromagnetic parts from non-ferromagnetic parts. The drums generally comprise a rotating shell, inside which a magnetic sector, being fixed with respect to the rotation axis of the drum, and a substantially non-magnetic sector are present. The inductive magnetic field is generated by means of solenoids connected to a power supply and powered with continuous current. The material is conveyed towards the drum by means of a conveyor, e.g. a conveyor belt, a vibrating plane or a slide. When the material passes in correspondence to the drum, the ferromagnetic parts are subject to the magnetic field produced by the magnetic sector of the drum and are attracted onto the surface of the rotating drum, whereas the non-ferromagnetic parts fall by their own weight into a collection zone of inert materials. During the rotation, the ferromagnetic material attracted onto the cylinder surface of the drum passes beyond the magnetic sector and falls by gravity into a different collection zone.

Examples of electromagnetic separators of the above-mentioned type are given e.g. in patent application WO 2005/120714 and in patents GB 607682, GB 100062and GB 152549.

Despite the numerous construction and operation types of the separation plants, the separation processes of ferromagnetic parts by means of electromagnetic drums do not allow to make a selection between plain ferromagnetic parts and ferromagnetic parts containing copper. Therefore, the latter must be manually separated with very high costs due to the large amounts of material treated in the separation plants. In addition, it is rather difficult to identify copper in ground pieces, as, due to the grinding, it has a color being substantially grey and uniform with the color of the remaining material.

Patent GB 1083581 describes a process for the separation of ferromagnetic material from basic slag ground to a small particle size. The slag is passed through at least one high intensity magnetic field separator and separated into at least two fractions, one having an increased phosphorus content and another having an increased iron content. Ferromagnetic material can be removed by prior passage through a low intensity magnetic field.

U.S. Pat. No. 4,062,765 describes an apparatus and process for the separation of particles of different density with magnetic fluids. The separation is accomplished by levitation of a mixture of particles containing magnetic particles in a magnetic fluid using a multiplicity of magnetic gaps created by a grid of magnetic poles, whereby the magnetic particles can be brought to a separation zone.

Another problem of the separation processes by means of magnetic separators is related to temperature. In the course of a normal work cycle (8-16 hours), the absorbed power tends to decrease due to Joule effect. In fact, the electric current flow generates heat with a power equal to the product of the potential difference at its terminals and the intensity of the current flowing through it. Since this phenomenon causes the increase of the electrical resistance and the energy loss in the electricity transport lines, the magnetomotive force generated by the solenoids considerably decreases with consequent losses of efficiency in the collection of ferromagnetic material.

Object of the present invention is thus to provide a separation device of ferromagnetic materials being free from such drawbacks. Such an object is achieved by means of an electromagnetic separator and a separation method, the main features of which are specified in claims 1 and 21, respectively, while other features are specified in the remaining claims.

Thanks to the particular choice and setting of the operation parameters of the separator solenoids, it is possible to separate the ferromagnetic parts having a negligible or null copper percentage from the ferromagnetic parts having a notable copper percentage, rotor coils in particular, in order to carry out manual operations only on this flow of ferromagnetic parts.

Further, the particular choice and setting of the operation parameters allow the stabilization of the magnetic field and the magnetomotive force, thus allowing to keep the optimal operation conditions throughout the whole work cycle.

In addition, the separator and the separation method according to the present invention allow the attraction of all types of ferromagnetic parts forming the ground material, comprising those having low form factors, i.e. the ratio between height and section diameter, such as rotors, for instance.

Further advantages and features of the device and the separation method according to the present invention will become evident to those skilled in the art from the following detailed description of an embodiment thereof, with reference to the annexed drawing, which shows a schematic cross-sectional view of a drum magnetic separator.

The FIGURE shows an electromagnetic separator comprising a drum 1 and a conveyor 2 conveying the material to be separated towards drum 1.

Drum 1 includes a cylindrical shell 3 and it is rotatable around its axis by means of a motor and a chain drive, for example. In the FIGURE, arrow F indicates a probable way of rotation of drum 1. The cylindrical shell 3 is provided with a plurality of raised profiles 4, which are arranged along the longitudinal direction of the drum parallel to its axis and help to transport the ferromagnetic material attracted by drum 1 on the surface of shell 3 during the drum rotation. Solenoids 6 and 7 are arranged inside chamber 5, enclosed by the cylindrical shell 3 of drum 1, said solenoids being connected to a continuous current power supply 8 arranged outside the drum. These solenoids 6 and 7, being powered with a continuous current, generate a magnetic field capable of attracting onto drum 1 the ferromagnetic parts forming the material conveyed by conveyor 2, including those having low form factors, equal to 2.5 for example. The north pole N of the magnetic field generated by solenoids 6 and 7 is near the end of conveyor 2, at a distance Δ therefrom comprised between 10 and 30 cm. The south pole S is oriented substantially perpendicular with respect to the north pole N along the rotation direction of drum 1. Therefore, solenoids 6 and 7 define in chamber 5 of drum 1 a magnetic sector comprised between 150° and 180° arranged in front of drum 1, i.e. close to conveyor 2, and a substantially non-magnetic sector comprised between 180° and 210° arranged behind drum 1, i.e. far from conveyor 2.

The material conveyed towards drum 1 by means of conveyor 2 is separated and collected into two zones A and B arranged behind drum 1, under the non-magnetic sector, and in front of it, under the end of conveyor 2, respectively. The parts of ferromagnetic material with a lower copper percentage, indicated in the figure by means of an asterisk, adhere to shell 3 of drum 1 and are collected into zone A, whereas the parts of non-ferromagnetic material and/or ferromagnetic material with a higher copper percentage, indicated in the figure by an ellipse, are directly discharged into zone B by conveyor 2. In order to let a part made of ferromagnetic material to be attracted by the magnetic field of drum 1, a specific magnetomotive force, or a force for unit volume, higher than the mean specific gravity of steel, substantially equal to 78.5 N/dm$^3$, must be generated. The parts of ferromagnetic material characterized by an additional content of copper have, on the contrary, a higher specific gravity, depending on the weight percentage of added copper. Therefore, on equal form factor, in order to effectively select plain ferromagnetic parts without attracting those containing copper, it is necessary that the attraction force generated by the specific magnetomotive force is higher than the mean specific gravity of steel, but lower than the specific gravity of the ferromagnetic parts containing copper. In fact, the ferromagnetic parts having a lower copper percentage will thus be attracted by the magnetic field generated by solenoids 6 and 7 and then separated, whereas those with a higher copper percentage will remain together with the non-ferromagnetic parts, which are generally a negligible amount as they have been already separated by another separator placed upstream.

As explained above, it is clear that the values of the attraction force, i.e. the values of the magnetic field and its gradient, must be precisely identified and fixed. In order to identify such parameters, the inventors carried out an intense research and experimentation activity. For example, in the rather frequent case that the ground material coming out from a grinding mill contains rotors, the copper percentage of the ferromagnetic parts which must not be attracted by the magnetic field generated by solenoids 6 and 7 is typically comprised between 12% and 20% by weight. The specific gravity of the rotor samples containing copper is thereby comprised between 87.9 N/dm$^3$ (12% of copper) and 94.2 N/dm$^3$ (20% of copper). The inventors found that the values of magnetic field intensity and field gradient being effective for the separation of the ferromagnetic parts only are, in this case, equal to 47750±5% A/m for the magnetic field intensity and equal to 1750±5% A/m for the gradient, respectively, thus generating a specific attraction force comprised between 80 and 81 N/dm$^3$. In fact, such a specific force is higher than the iron specific gravity and lower than the specific gravity of the ferromagnetic parts containing copper.

The range of the values of the specific attraction force suitable for selecting the ferromagnetic parts from the non-ferromagnetic ones and/or the ones containing a considerable weight percentage of copper is rather narrow, so that it is very important that the performances of the system are constant throughout the whole work cycle of the electromagnetic drum. In order to keep constant the system performances throughout the whole work cycle of an electromagnetic drum, it is necessary to keep constant the magnetomotive force generated by means of the electromagnetic circuit. The magnetomotive force produced by the coils of the solenoids is the product of the current and the number of turns, so that, by powering solenoids 6 and 7 with a substantially constant current, it is possible to keep the magnetomotive force substantially constant. In addition, it is possible to suitably choose and set the current values to obtain the most effective values of the attraction force, in order to increase the efficiency of the separation process. In order to keep substantially constant the supplied current, the power supply 8 regulates the supply voltage. Consequently, the power absorbed by the system will vary proportionally to the product of voltage and current.

In order to minimize the problems of operation efficiency loss due to the Joule effect, solenoids 6 and 7 are provided with conductors having a large cross-section. This allows to obtain low values of electrical current density and thereby to minimize the increases of electrical resistance due to the Joule effect during the work cycle. Suitable values of the cross-section area of the conductors used for the manufacturing of the solenoids are comprised between 70 and 80 mm$^2$, for example. Suitable values of electrical current density are comprised between 0.2 and 0.7 A/mm$^2$, for example, and preferably comprised between 0.45 and 0.5 A/mm$^2$. Still in the aim to minimize energy dissipation due to the Joule effect, it has been chosen to operate solenoids 6 and 7 at powers being much lower than those of the electromagnetic separators of the prior art. Suitable power values are for example comprised between 4 and 6 kW, being comprised between 25% and 40% of the power of the prior art separators. Therefore, on equal structure of solenoids 6 and 7, there will be a greater mass for each kW of absorbed power. In particular, the mass of a solenoid 6 or 7 for each kW of absorbed power is higher than 200 kg/kW and preferably comprised between 380 and 500 kg/kW.

By comparing the operation of the plant at a constant voltage, i.e. according to the prior art, with the operation at a constant current, i.e. according to the present invention, it is noticed that throughout the work cycle at a constant voltage, e.g. at 230V, the increase of electrical resistance due to the Joule effect results in a decrease of the current absorbed during the cycle (I=V/R), e.g. from 69.5 to 42 A. Consequently, power (W=V·I) and current density (δ=I/conductor_cross_section_area) are reduced, e.g. from 16000 to 9600 W and from 0.919 to 0.604 A/mm$^2$, respectively. The magnetomotive force (F=number_of_turns·I) generated by the magnetic field is reduced, e.g. from 163230 ampere-turn to 98642 ampere-turn, with a loss of attraction capability of indeed 39.6% and the consequent performance loss of the separator.

In the operation at a constant current, e.g. at 35 A, according to the present invention the voltage is increased proportionally to the increase of electrical resistance due to the Joule effect (V=R·I), for example from 115 to 175 V. Consequently, the power increases (W=V·I), for example from 4000 to 6125 W, in the course of the cycle. As a result, the substantial constancy of the current results in the substantial constancy of the current density (δ=I/conductor_cross_section_area), which is comprised, for example, between 0.45 and 0.5 A/mm$^2$ with conductors having a cross-section comprised between 70 and 80 mm$^2$, and, in particular, the substantial constancy of the magnetomotive force (F=number_of_turns·I), for example equal to 82200 A per turn for the whole duration of the cycle.

The electromagnetic separator according to the present invention allows to stabilize the electromagnetic force and, thereby, to keep such a force within the narrow range of values suitable for obtaining the separation of substantially the ferromagnetic material parts only during the whole work cycle. The separation efficiency is thus remarkably increased.

Possible variations and/or additions may be made by those skilled in the art to the hereinabove described and illustrated embodiment of the invention, while remaining within the scope of the following claims.

The invention claimed is:

1. A method for separating ferromagnetic parts with different percentages of copper comprising the following operating steps:

transporting the ferromagnetic parts by means of a conveyor (2);

arranging an electromagnetic separator, provided with a rotatable drum (1), at the end of said conveyor (2);

generating a magnetic field by supplying continuous current to solenoids (6, 7) inserted in said drum (1);

rotating the drum (1), characterized in that the attraction force generated by a magnetomotive force per unit volume resulting from the magnetic field is higher than the mean specific gravity of steel, but lower than the specific gravity of ferromagnetic parts containing a copper percentage of at least 12% by weight.

2. A method according to claim 1, characterized in that said attraction force generated by the magnetomotive force per unit volume is comprised between 78.5 $N/dm^3$ and 87.9 $N/dm^3$.

3. A method according to claim 2, characterized in that said attraction force generated by the magnetomotive force per unit volume is comprised between 80 $N/dm^3$ and 81 $N/dm^3$.

* * * * *